United States Patent [19]

Moller

[11] 4,003,488

[45] Jan. 18, 1977

[54] TEAR OPEN BOTTLE CAP

[75] Inventor: Thomas G. Moller, Rahway, N.J.

[73] Assignee: American Flange & Manufacturing Co., Inc., Linden, N.J.

[22] Filed: Mar. 15, 1976

[21] Appl. No.: 667,266

Related U.S. Application Data

[63] Continuation-in-part of Ser. No. 581,881, May 29, 1975.

[52] U.S. Cl. ..... 215/254

[51] Int. Cl.[2] ..... B65D 41/42

[58] Field of Search ..... 215/254, 253, 255, 256

[56] References Cited

UNITED STATES PATENTS

| | | | |
|---|---|---|---|
| 906,875 | 12/1908 | Hammer | 215/254 |
| 2,068,444 | 1/1937 | Breckenridge | 215/254 |
| 3,380,609 | 4/1968 | Potts | 215/254 |
| 3,963,140 | 6/1976 | Harding | 215/254 |

*Primary Examiner*—Donald F. Norton

[57] ABSTRACT

A tear open bottle cap formed of lightweight sheet metal having a circular top panel surrounded by a cylindrical skirt connected thereto by a radiused juncture portion. An integrally formed pull member extends away from the skirt edge with a score line commencing at either side of the pull member extending upwardly across the cap skirt. The score lines diverge outwardly away from each other within the radiused juncture portion and continue part way about the periphery of the cap top panel in a circular path. The terminal portions of the score lines extend outwardly into the cap skirt at spaced positions opposite the pull member. An annular sealing gasket is disposed within said cap top so as to lie just radially inwardly of the circular scoring.

5 Claims, 5 Drawing Figures

TEAR OPEN BOTTLE CAP

This application is a continuation-in-part of pending application Ser. No. 581,881 filed May 29, 1975.

BACKGROUND OF THE INVENTION

This invention is concerned with the structural improvement of tear open convenience bottle caps formed out of lightweight sheet metal. One aspect of known tear open bottle caps, where the need for further refinement has become particularly apparent, concerns the easy removal of the cap from the underlying bottle lip or finish at the termination of the tearing action. Such removal, for optimum consumer acceptance, must be effected with minimal effort to avoid sloshing and spillage resulting from the instability of the bottle and its attached cap caused by the applied pressure to remove the cap from the bottle. Variations in tearing pattern as determined by existing score line configurations have not, as yet, completely fulfilled the above mentioned need in that the other basic strength requirements of the cap must still be met at the same time removal is being eased. Consequently, optimum positioning of the cap scoring must advantageously provide for adequate pressure retention as well as ease of tearing prior to cap removal and finally ease of cap removal from the bottle lip.

Heretofore, the common practice in making tear open container closures employing score lines to facilitate opening was to cover the scoring, if not completely then at least partially, with the closure gasket. The flowed-on type gasket most frequently used would then adhere to the interior surface of the closure at the score line area so that removal of the closure or cap requires tearing through the cured gasket. In the hand removal of lightweight metal convenience bottle caps, the tear factor at the score line is very important. Any added restraint, such as that imposed by tearing through the cap gasket, is quite significant and has a direct bearing on consumer acceptance of the closure. In addition, the use of high temperature resistant gasket compounds such as required for commonly employed sterilization food processing only further aggravates the problem with their commensurately greater resistance to tearing.

SUMMARY

The bottle cap herein disclosed seeks to improve over prior art constructions in providing a tear open bottle cap which eliminates the need to tear through the cap gasket upon opening. This is accomplished by employing a score line configuration having curved portions which lie outside the periphery of cap top panel. An annular sealing gasket formed in situ on the cap interior surface is positioned just radially inwardly of the semi-circular curved score lines. Consequently, the substantial resistance to tearing previously encountered in tearing through the cap gasket is completely eliminated. A minimal removal force just sufficient to sever the thin residue of metal remaining at the score line is all that is required to remove the invention cap from a bottle. In addition, the particular scoring pattern herein disclosed offers the advantage of allowing the major part of the cap top panel to be lifted upwardly off of the underlying bottle finish as the cap is being torn open, leaving only a very narrow surrounding portion of the cap skirt for easy dislodgement from the bottle at the termination of the tearing action.

It is, accordingly, a principal object of the invention to provide an improved lightweight metal tear open closure for containers which is easily hand removable.

Another object is to provide a metal tear open bottle cap having an improved score pattern which substantially reduces the pull force required to tear open the cap and remove it from the underlying bottle lip.

Still another object is to provide a scored metal tear open cap wherein tearing through the cap gasket is avoided to ease removal.

Other and more detailed objects will in part be obvious and in part pointed out as the description of the invention, taken in conjunction with the accompanying drawing proceeds. In that drawing.

Figure 1:
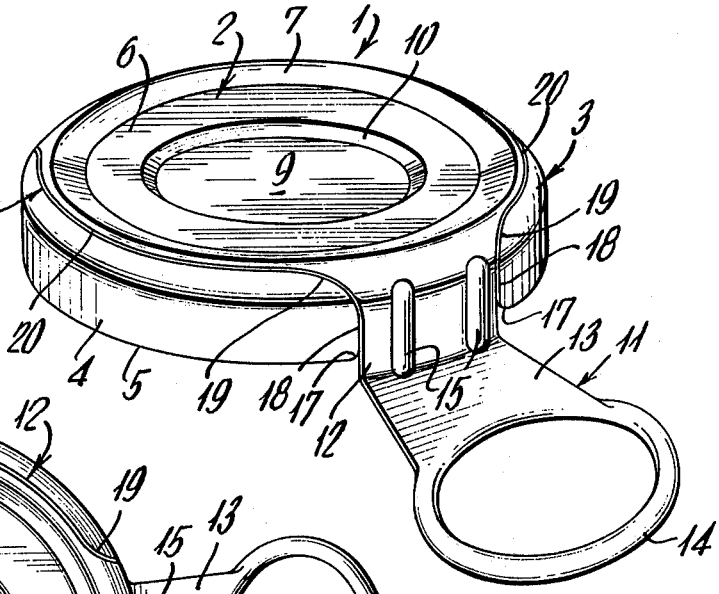
FIG. 1 is a perspective view of the closure cap in accordance with the invention.
Figure 2:
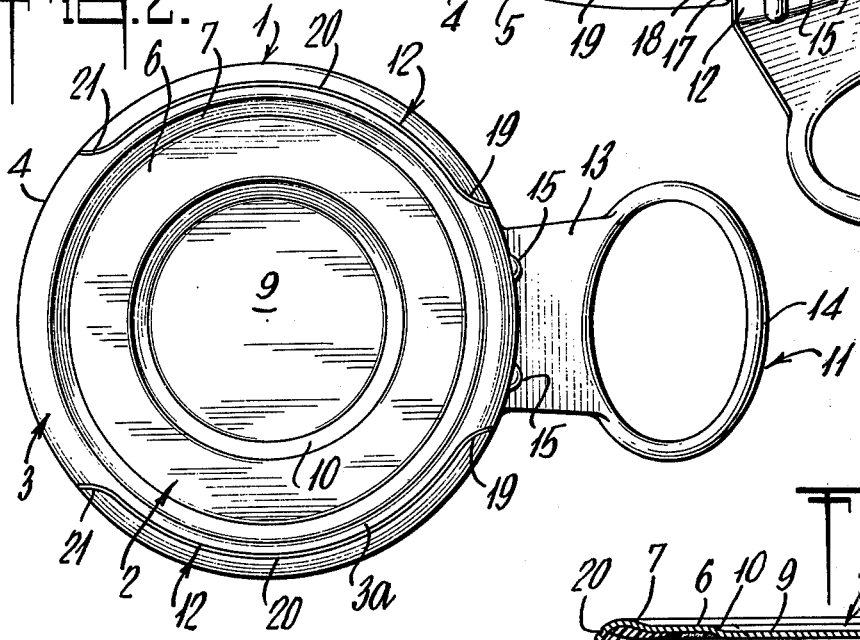
FIG. 2 is a top plan view thereof.
Figure 3:
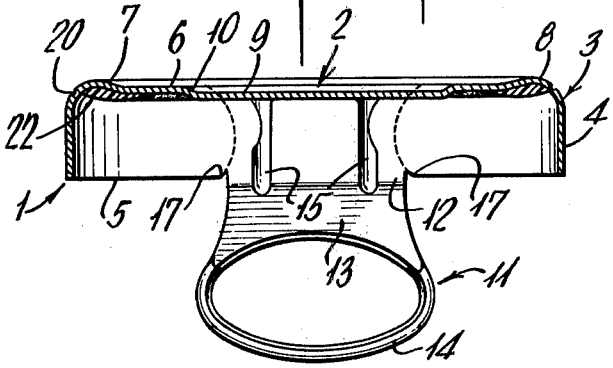
FIG. 3 is a view taken along lines 3—3 in FIG. 2 and looking in the direction of the arrows.

The closure cap of the invention, generally indicated by numeral 1 and, as shown in FIGS. 1 and 2, is formed out of lightweight sheet metal and is seen to comprise a circular top panel 2 surrounded by a radiused juncture portion 3. A cylindrical skirt 4 depends from the juncture portion 3 and terminates in a lowermost free edge 5. A major circular embossment 6 is formed in the top panel 2 and extends radially outwardly blending into the radiused juncture portion 3 in a gradually inclined outer step portion 7 thus forming a shallow inverted channel 8 as clearly seen in FIG. 6. In addition, a minor embossment 9 is centrally disposed within the major embossment 6 defined by an inner step 10. The closure cap 1 is further provided with a gripping ear 11 extending downwardly from the skirt free edge 5 in a short neck 12 and then extending radially outwardly and downwardly in a base portion 13 which merges into a pull ring 14. A pair of parallel, outwardly embossed reinforcing ribs 15 extend vertically from the base portion 13 across the neck 12 and skirt 4 and terminate at the radiused juncture portion 3.

A pair of score lines generally indicated at 16 are formed in the cap body and, for illustration purposes, shown as being formed in the exterior surface of the cap, although interior scoring could also be employed. Each of the score lines commence at a notch 17 formed in the skirt edge 5 at either side of the neck portion 12 and extend upwardly across the cap skirt 4 as indicated at 18. Upon entering the radiused juncture portion 3, the score lines flare outwardly away from each other at 19 and blend into a circular path, as shown at numeral 20 in FIG. 2, extending part way about the periphery of the cap top panel 2. The curved score line portions 20 are radially positioned within the radiused juncture portion 3 so as to define the outer wall **3*a* of the inverted channel 8. Each score line portion 20 continues along this circular path to a point angularly displaced approximately 45° beyond the cap midsection and then flares radially outwardly at 21 terminating at the cap skirt 4 on the opposite side of the cap from the gripping ear 11**.

Figure 4:
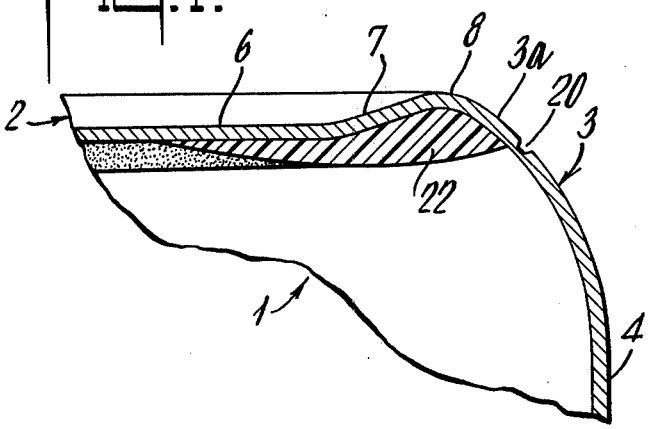
FIG. 4 is an enlarged fragmentary sectional view showing the juxtaposed relationship between the sealing gasket and the semi-circular scoring.

An annular sealing gasket 22, consisting of a vinyl resin plastisol, as a nonlimiting example, is formed in situ within the cap interior. As clearly seen in FIG. 4, the gasket 22 completely occupies the shallow inverted channel 8 created by the embossed top panel outer step 7 and the radiused juncture portion 3*a* disposed above the score line portion 20. This gasket configuration leaves the score line 20 exposed just below the outer edge of the gasket with the inner edge of the gasket flowing radially inwardly from the channel 8 to form an effective top seal when applied to a container. This arrangement of placing the score line completely outside the gasket offers the advantage of protecting the score line area against exposure to the packaged product without resort to costly post-coating operations. Such protection is frequently required where lack of product compatibility may cause a chemical attack on the closure cap base metal with resultant contamination of the packaged product. Even with scoring on the outside surface of the cap, a certain amount of damage occurs to the interior surface coatings which must still be protected.

Figure 5:
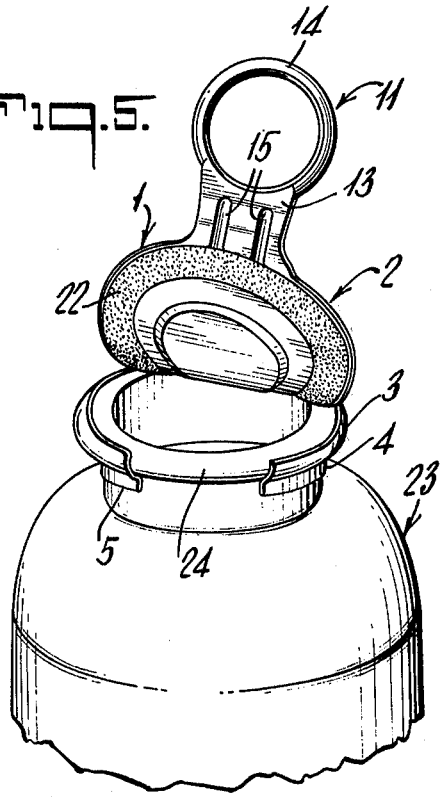
FIG. 5 is a perspective view of the closure in torn open position just prior to separation from a bottle.

A bottle 23 provided with a circumferentially enlarged lip 24 surrounding the bottle neck opening is shown in FIG. 5. The closure cap 1 of the invention is here shown in an intermediate opening position with the cap in torn open condition but prior to complete separation from the underlying bottle lip 24. In addition to the already described advantages resulting from the improved score pattern of the invention, opening and removal of the cap is similarly enhanced. A substantial amount of tearing resistance has heretofore been encountered as the sealing gasket 22 is severed during tearing of the cap from the underlying bottle neck. As is clearly evident from the above described gasket-score line relationship, any tearing through the relatively tough gasketing material has been completely avoided. The only tearing force required to uncap the bottle is that necessary to sever the very thin section of remaining metal at the score line.

Finally, the instant score line configuration has been found to make a significant improvement in the ease with which the torn open cap is separated from the bottle. This ease of cap removal comes about by reducing to a minimum the ability of the remaining cap portions to grip the underlying bottle lip 24. With the score pattern herein disclosed, only a narrow band of metal consisting of the skirt portion 4 and the remaining part of the radiused juncture portion 3 is left in engagement with the bottle lip after tearing. Completion of the tearing action occurs when the metal becomes severed along the full extent of the score line 20 and the terminal points remote from the gripping ear are reached. The normal pulling force applied to the ring 11 then causes the relatively flimsy remaining cap portion to be quite easily disloged from the underlying bottle lip 24 thus avoiding any undesirable sloshing or spillage of the bottle product.

From the foregoing it is readily apparent that numerous advantages result from the closure cap of the invention as above described. It should be noted that variations in the cap construction could be employed such as varying the construction or shape of the cap gripping ear. Also different gasketing systems could be employed such as an overall liner adhered or frictionally retained within the cap interior.

Still other changes in and modifications of the construction and different embodiments of the invention would suggest themselves to those skilled in the art and could be made without departing from the spirit or scope of the invention. It is, accordingly, intended that all matter contained in the above description, or shown in the accompanying drawing shall be interpreted as being illustrative and not in the limiting sense.

I claim:

1. A lightweight metal tear-off cap comprising a circular top panel surrounded by a cylindrical skirt terminating in a lowermost free edge, a radiused juncture portion connecting said top panel and said skirt, a gripping ear formed as an integral part of said skirt extending from said free edge, a tearing zone commencing at said skirt free edge adjacent said gripping ear and extending upwardly across said skirt and blending into a circular path lying within said radiused juncture portion, said tearing zone extending rearwardly from said gripping ear to at least partially surround said cap top panel and a sealing gasket adhesively affixed to said cap interior disposed radially inwardly of said tearing zone along said path whereby tearing along said exposed tearing zone independently of said gasket causes the major portion of said cap top panel to be separated from said cap skirt upon opening.

2. A lightweight metal tear open cap as in claim 1 including a tearing zone commencing at said skirt free edge on either side of said gripping ear.

3. A lightweight metal tear open cap as in claim 1 wherein said sealing gasket extends radially outwardly to a position in close proximity to said circular tearing zone path.

4. A lightweight metal tear open cap as in claim 1 including a concentric depressed embossment in said cap top panel.

5. A lightweight metal tear open cap as in claim 4 wherein a gasket receiving channel is formed by said embossment about the periphery of said cap top panel.

* * * * *